US008794421B2

(12) United States Patent
Senger et al.

(10) Patent No.: US 8,794,421 B2
(45) Date of Patent: Aug. 5, 2014

(54) REMOTE CONTROLLED PASSENGER CONVEYOR AND METHOD FOR REMOTELY CONTROLLING A PASSENGER CONVEYOR

(75) Inventors: Alois Senger, Gresten (AT); Abdullah Ercan, Vienna (AT)

(73) Assignee: Otis Elevator Company, Farmington, CT (US)

( * ) Notice: Subject to any disclaimer, the term of this patent is extended or adjusted under 35 U.S.C. 154(b) by 3 days.

(21) Appl. No.: 13/814,780

(22) PCT Filed: Aug. 20, 2010

(86) PCT No.: PCT/US2010/046065

§ 371 (c)(1),
(2), (4) Date: Feb. 7, 2013

(87) PCT Pub. No.: WO2012/023943

PCT Pub. Date: Feb. 23, 2012

(65) Prior Publication Data

US 2013/0140134 A1 Jun. 6, 2013

(51) Int. Cl.
*B66B 25/00* (2006.01)

(52) U.S. Cl.
CPC ..... *B66B 25/00* (2013.01)
USPC ..... 198/322

(58) Field of Classification Search
CPC ..... B66B 25/00; B66B 27/00; B66B 29/00
USPC ..... 198/322, 323
See application file for complete search history.

(56) References Cited

U.S. PATENT DOCUMENTS

| | | | | |
|---|---|---|---|---|
| 2,602,524 | A | 7/1952 | Shirley | |
| 5,782,330 | A * | 7/1998 | Mehlert et al. | 198/324 |
| 6,606,538 | B2 * | 8/2003 | Ponsot et al. | 198/322 |
| 7,448,473 | B2 | 11/2008 | Lindberg et al. | |
| 2003/0007665 | A1 * | 1/2003 | Ponsot et al. | 382/103 |
| 2005/0088520 | A1 | 4/2005 | Wiesinger et al. | |
| 2007/0170037 | A1 * | 7/2007 | Kuroda | 198/322 |
| 2007/0261924 | A1 | 11/2007 | Lindberg et al. | |

FOREIGN PATENT DOCUMENTS

| | | | |
|---|---|---|---|
| EP | 1013599 | A1 | 12/1998 |
| EP | 1308410 | B1 | 6/2000 |
| EP | 1419988 | A1 | 10/2003 |

(Continued)

OTHER PUBLICATIONS

International Search Report and Written Opinion for related International Application No. PCT/US2010/046065 Filed on Aug. 20, 2010; Report Dated Mar. 7, 2013.

*Primary Examiner* — James R Bidwell
(74) *Attorney, Agent, or Firm* — Miller, Matthias & Hull LLP

(57) ABSTRACT

A system and method for remotely controlling a passenger conveyor is disclosed. The system and method may include capturing an image of a passenger conveyor and a status changing object with a camera, sending an initiate command from a remote control center to the status changing object, calculating a time delay based on a time the initiate command is sent from the remote control center to a time the image of the status changing object verifies that the status changing object is responding to the initiate command, confirming that no passengers are present on the passenger conveyor and initiating a limited time frame for remote control of the passenger conveyor based on the time delay calculated.

20 Claims, 5 Drawing Sheets

(56) References Cited

FOREIGN PATENT DOCUMENTS

| | | | |
|---|---|---|---|
| JP | 5319762 | | 12/1993 |
| JP | 2000053361 | A | 2/2000 |
| JP | 2002068656 | A | 3/2002 |
| JP | 2005162368 | A | 6/2005 |
| JP | 2006117336 | A | 5/2006 |
| JP | 2007070061 | A | 3/2007 |
| JP | 2007131411 | A | 5/2007 |
| JP | 2007137556 | A | 6/2007 |
| JP | 2008074527 | A | 4/2008 |
| WO | WO9943603 | | 9/1999 |
| WO | WO-2006/048497 | A1 | 5/2006 |
| WO | WO-2009/152766 | A1 | 12/2009 |

* cited by examiner

REMOTE CONTROLLED PASSENGER CONVEYOR AND METHOD FOR REMOTELY CONTROLLING A PASSENGER CONVEYOR

CROSS-REFERENCE TO RELATED APPLICATIONS

This application is a U.S. national stage filing under 35 USC §371 of International Patent Application No. PCT/US10/46065, filed on Aug. 20, 2010.

FIELD OF THE DISCLOSURE

The present disclosure generally relates to passenger conveyors and, in particular, relates to apparatus and methods for remotely controlling passenger conveyors.

BACKGROUND OF THE DISCLOSURE

Passenger conveyors are in widespread use to transport a passenger from one destination to another destination rapidly. For example, elevators carry passengers vertically within a building, while escalators have been designed to get a passenger from one level to another level more expediently than climbing stairs. Even moving walkways have accelerated the process of walking by more expediently getting a passenger horizontally from one position to another position. Passenger conveyors are commonly installed in publicly used areas such as office buildings, airports, and shopping centers, for example.

Although passenger conveyors have brought convenience in public areas by transporting numerous passengers from one destination to another destination rapidly, passenger conveyors require constant maintenance. Certain circumstances during either proper usage, such as maintenance for normal wear-and-tear, or improper usage, such as an accident, may cause the stop of a passenger conveyor.

In addition, passenger conveyors may also be required to operate in compliance with stringent safety codes and regulations. For example, safety devices must be provided and equipped to ensure that there are no passengers present before sending a control signal to the control unit of the passenger conveyor. Therefore, safety devices must be certified to fulfill code requirements and regulations. Such certified safety devices are expensive, limited to one unit only, and cannot easily be updated to comply with changing passenger conveyor conditions.

Therefore, a need for a universal, upgradable, and cost efficient safety control device/system for passenger conveyors still remains.

SUMMARY OF THE DISCLOSURE

In accordance with one aspect of the disclosure, a method for remotely controlling a passenger conveyor is disclosed. The method may include providing a status changing object capable of changing visually observable states; capturing an image of the passenger conveyor and the status changing object using a camera; sending the image captured by the camera to a remote control center capable of displaying the image received from the camera, and controlling the status changing object and the passenger conveyor; sending an initiate command from the remote control center to the status changing object; receiving an image of the status changing object responding to the initiate command; calculating a time delay based on a time the initiate command is sent to a time the image of the status changing object received by the remote control center from camera verifies that the status changing object is responding to the initiate command; and initiating a limited time frame for remote control of the passenger conveyor based on the time delay calculated.

In accordance with an alternative or additional aspect of the disclosure, a method for remotely controlling a passenger conveyor is disclosed. The method may include providing a status changing object capable of changing visually observable states; continuously capturing an image of the passenger conveyor and the status changing object using a camera; sending the captured image to a remote control center capable of displaying the image received from the camera, and controlling the status changing object and the passenger conveyor; sending continuously an initiate command consisting of a pattern to the status changing object, wherein the status changing object changes its visually observable state according to the pattern; receiving continuously an image of the status changing object responding to the initiate command; calculating continuously a time delay between a time the initiate command is sent to the status changing object to a time the image of the status changing object received by the remote control center from camera verifies that the status changing object is responding to the initiate command; initiating a limited time frame for remote control of the passenger conveyor based on the time delay calculated; and adjusting the image captured of the passenger conveyor based on the time delay calculated.

In accordance with yet another aspect of the disclosure, a passenger conveyor having a remote control system is disclosed. The passenger conveyor may include a status changing object associated with the passenger conveyor and capable of changing states; a camera associated with the passenger conveyor in such a manner as to capture an image of the entire passenger conveyor and the status changing object; and a remote control center remotely located from the passenger conveyor and capable of receiving the image from the camera and controlling the status changing object and the passenger conveyor within a limited time frame.

Other advantages and features will be apparent from the following detailed description when read in conjunction with the attached drawings.

BRIEF DESCRIPTION OF THE DRAWINGS

For a more complete understanding of the disclosed apparatus and method, reference should be made to the embodiments illustrated in greater detail in the accompanying drawings, wherein.

DETAILED DESCRIPTION OF THE DISCLOSURE

Figure 1:
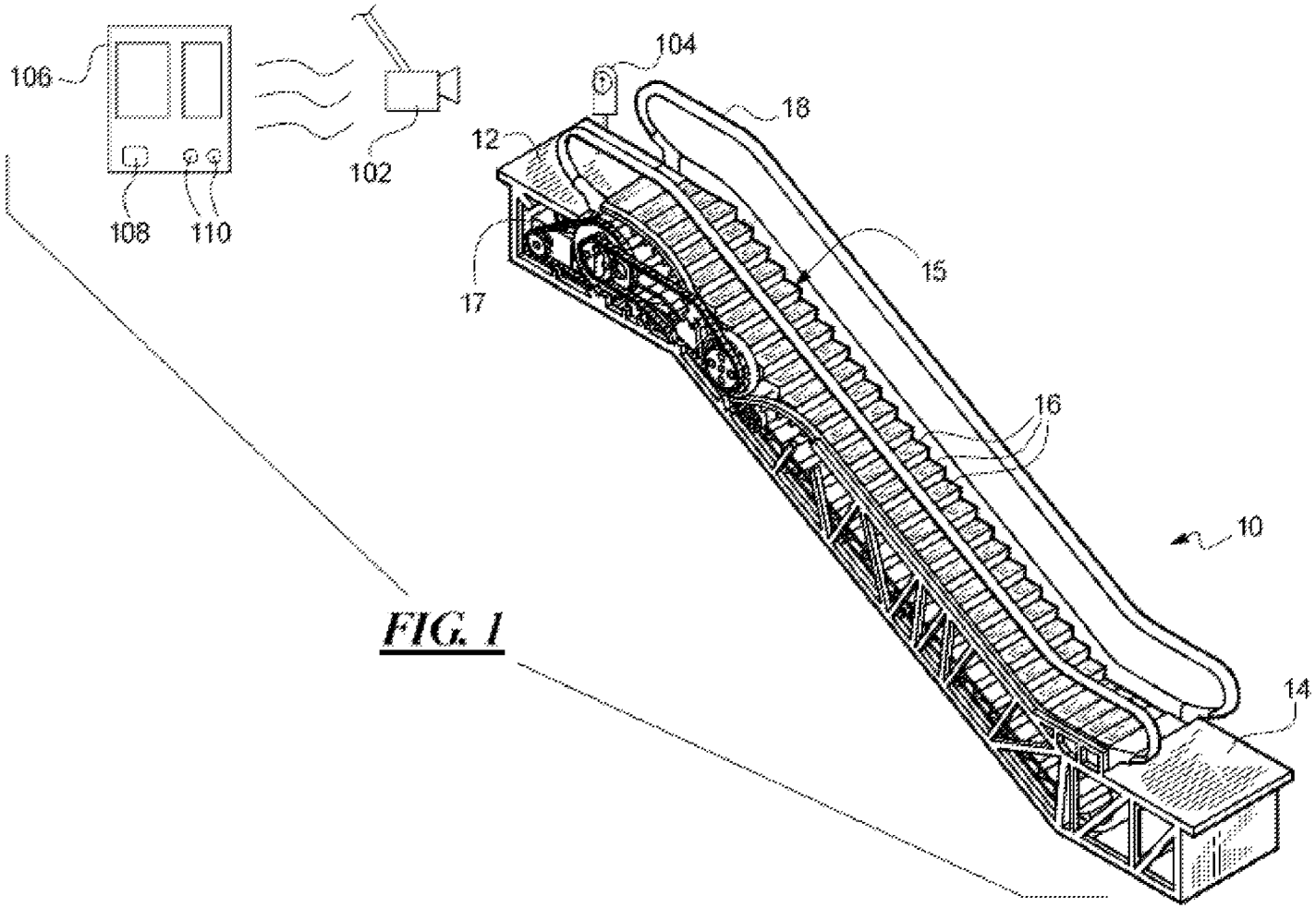
FIG. 1 is an embodiment of an escalator constructed in accordance with the teachings of the disclosure.

Referring now to the drawings, and with specific reference to FIG. 1, a passenger conveyor constructed in accordance with the teachings of the disclosure is generally referred to by reference numeral 10. More specifically, an escalator 10 will be used as the exemplary embodiment to describe a passenger conveyor in detail below. It is to be understood that this disclosure should not be limited only to escalators, however, rather that other exemplary embodiments such as a moving walkway and so forth may be substituted for the escalator and referred to herein as the passenger conveyor.

As shown in FIG. 1, an exemplary passenger conveyor 10, such as an escalator, may be provided having a first platform 12, a second platform 14, a step band 15 having a plurality of moving pallets or steps 16 extending between the first and second platforms 12, 14, as well as moving handrails 18 disposed alongside the plurality of steps 16. The steps 16 of the conveyor 10 may be driven by a main drive source 17, such as an electric motor, or the like, and may be caused to move between the platforms 12, 14. The main drive source 17 may rotate a drive shaft and associated gears to rotate closed loop step chains which mechanically interconnect the inner surfaces of the steps 16 from within the conveyor 10. Within each of the two landing platforms 12, 14, sprockets may guide the step chains and the attached steps 16 through an arc to reverse the direction of step movement and to create a return path in a cyclic manner. The handrails 18 may be moved by similar means as, and at a speed comparable to, the steps 16.

As the escalator 10 may be utilized by passengers, the components of the escalator 10, such as, but not limited to, the steps 16, may experience wear-and-tear over time and malfunction. Safety codes and regulations require that the functionality of the escalator 10 must prevent unsafe usage by a passenger. One method of ensuring that an escalator is functioning properly is by remotely monitoring, testing, and controlling the escalator.

Figure 2:
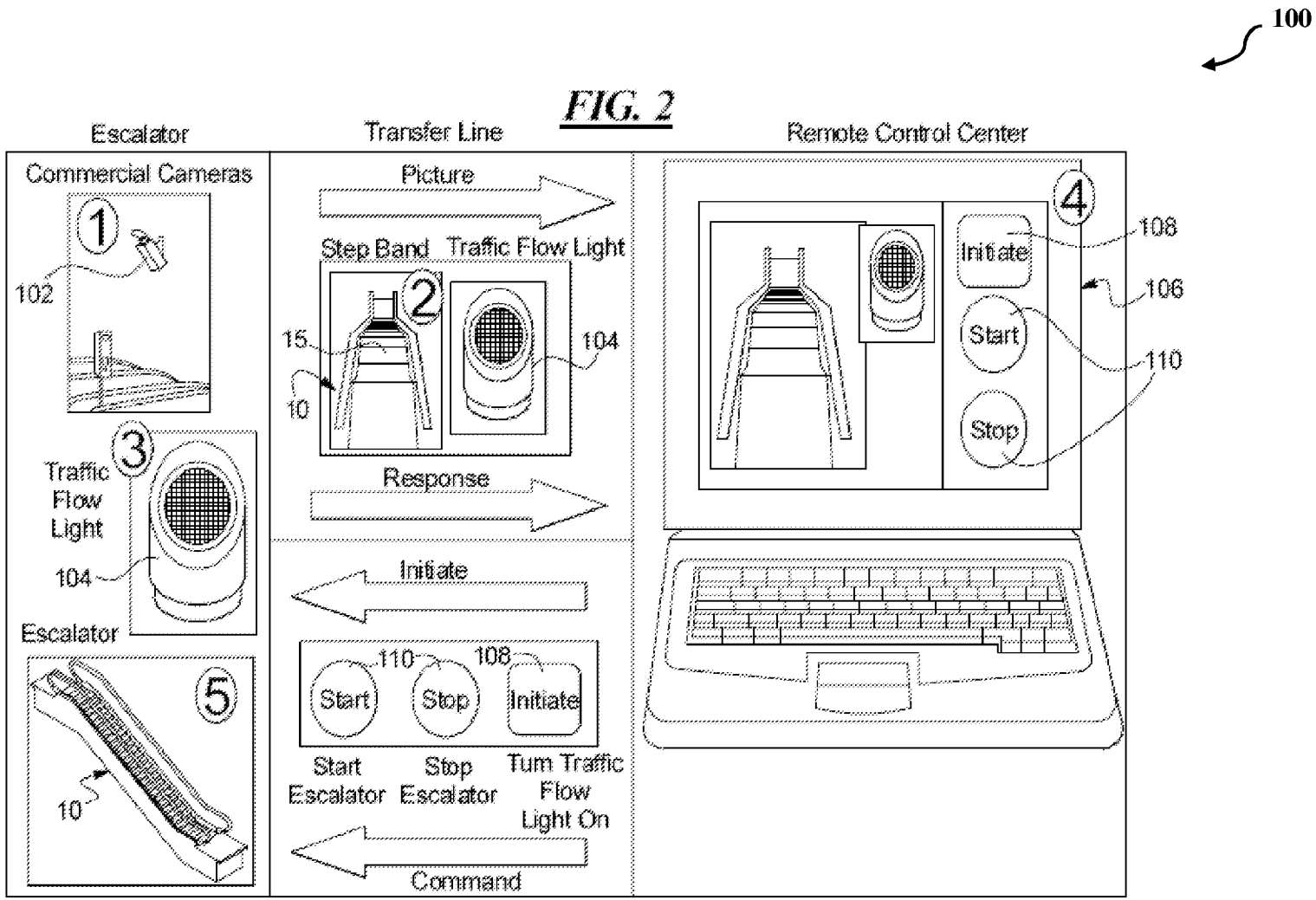
FIG. 2 is an embodiment of a remote control system for an escalator constructed in accordance with the teachings of the disclosure.

Referring now to FIG. 2, a remote control system 100 for a passenger conveyor is disclosed. The remote control system 100 may include a camera 102, a status changing object 104, and a remote control center 106. In one exemplary embodiment, the camera 102 may be a commercial camera. Currently, monitoring systems for passenger conveyors utilize certified cameras. Certified cameras have passed stringent testing to gain certification, ensuring that the cameras are compliant with codes and regulations for monitoring a passenger conveyor. This certification process may cause the certified cameras to be quite costly, especially when an upgrade is required wherein the cameras must be recertified. However, unlike current monitoring systems for passenger conveyors used in the market today, the remote control system 100 may be designed to incorporate commercial components such as, but not limited to, cameras and interface boards. Commercial cameras may be off-the-shelf cameras designed with no particular standards, i.e. codes and regulations, to satisfy. Such commercial cameras may be much more economical and adaptable than certified cameras. As will be described in further details herein, the remote control system 100 may utilize low-cost commercial cameras while still providing a reliable monitoring/controlling system that complies with the required codes and regulations for a passenger conveyor.

In one exemplary embodiment, the status changing object 104 may be a traffic flow light. Traffic flow lights may be commonly found near an escalator indicating the direction the escalator is traveling. It should be understood that the status changing object 104 should not be limited to a traffic flow light, but may incorporate any other device capable of providing a visual indicator and changing states such as, but not limited to, a flashing light and a digital clock. The status changing object 104 should be associated to the escalator 10 in such a manner that when the camera 102 captures an image of the step band 15 and the first and second platforms 12, 14, the status changing object 104 will be captured in the image, as well.

The remote control center 106 may be remotely located from the passenger conveyor 10, while being able to electrically communicate with the control system of passenger conveyor 10, camera 102, and status changing object 104. In one exemplary embodiment, the remote control center 106 may be a personnel computer (PC), such as a laptop, that may communicate with the passenger conveyor 10, camera 102, and status changing object 104 wirelessly. It should be understood that the remote control center 106 should not be limited to a PC or wireless communication, but may incorporate any other type of device and form of communication capable of communicating with and controlling the passenger conveyor 10, camera 102, and status changing object 104, as known to one skilled in the art. The remote control center 106 may be capable of depicting the images of the passenger conveyor 10 and the status changing object 104 on a single screen shot, while depicting an initiate command 108 and at least one button 110 for an operator to utilize when remotely controlling the passenger conveyor 10. In one exemplary embodiment, the initiate command 108 may send commands to the status changing object 104, requesting the status changing object 104 to change states. The at least one button 110 may allow for the escalator 10, particularly the step band 15, to be remotely controlled. In one exemplary embodiment, there may be at least two buttons 110, a 'start up' a 'start down' and 'stop' button, capable of starting and stopping the passenger conveyor 10. In other embodiments, the initiate command 108 and start up, start down and stop buttons 110 may be stand alone switches distinct from the screen shot shown.

In order to remotely control the escalator 10, certain codes and regulations must be satisfied. One particular requirement is to ensure that no passengers are present on or near the escalator 10 during remote operation of the escalator 10. Certified equipment, such as cameras, have been repeatedly tested to ensure reliability of the image captured of the escalator 10 while remotely controlling the escalator 10. However, the remote control system 100 may ensure that a current refreshed image of the correct selected escalator is being viewed when performing remote operations while utilizing non-certified equipment.

Figure 3:
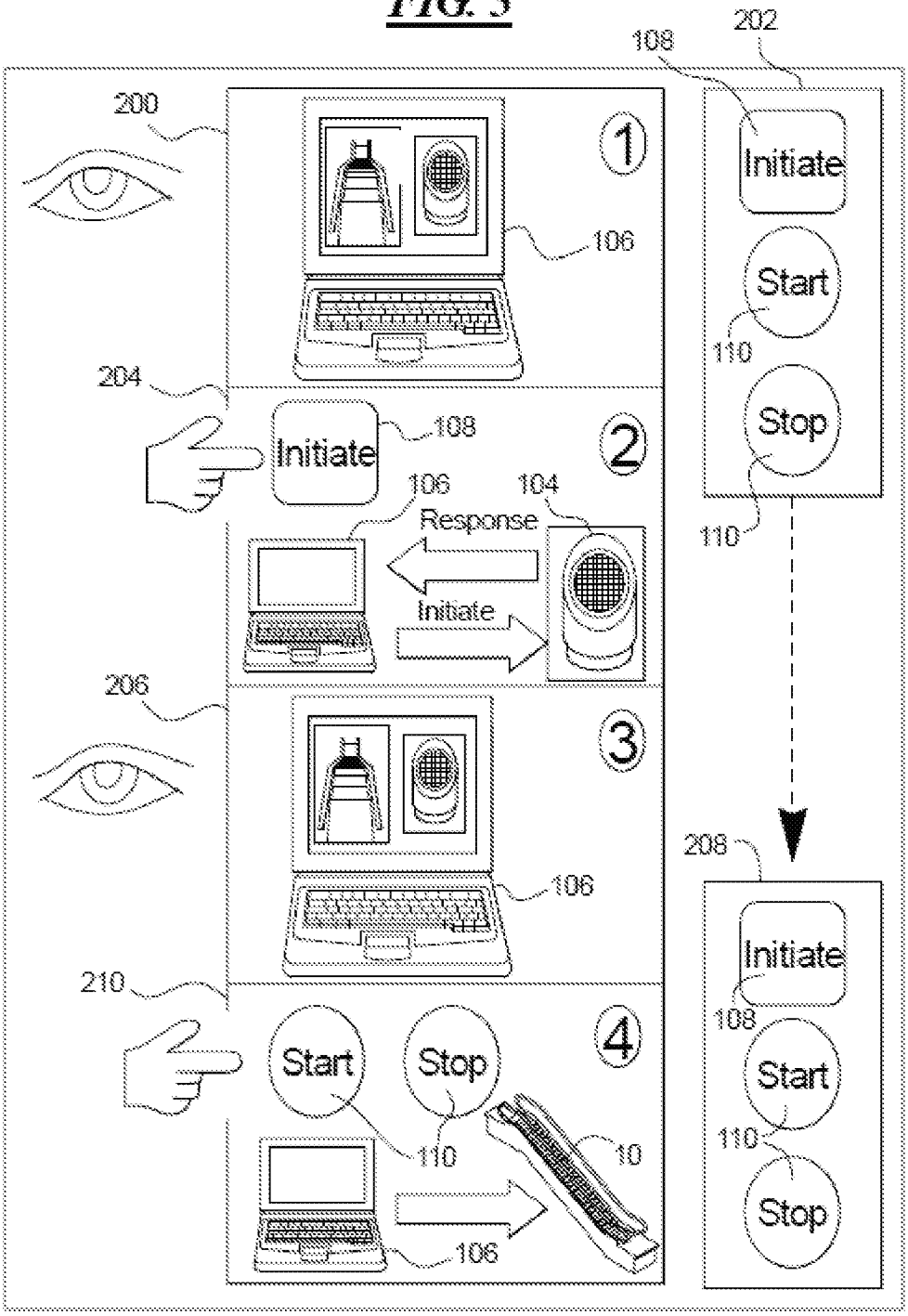
FIG. 3 is pictorial representation of a sample sequence of steps which may be practiced in accordance with the teachings of the present disclosure.

In FIG. 3, a pictorial representation of a sequence of steps, wherein the remote control system 100 may control the passenger conveyor 10 in real time, is disclosed. The first step 200 may be to view the images of the passenger conveyor 10 and the status changing object 104, which in this example is a traffic flow light, captured by the camera 102 in the screen shot of the remote control center 106, which in this example is a laptop. The third step 204 may be to send the initiate command 108, requesting the traffic flow light 104 to change states. Prior to sending the initiate command 108 and during a verification time frame, the start and stop buttons 110 may be in an inactive state, in second step 202. Once the initiate command 108 is sent in third step 204, the image of the traffic flow light 104 responds to the initiate command 108 by changing states, which is verified by the screenshot of the laptop 106 in the fourth step 206. In step 206, the passenger conveyor 10 may also be verified to ensure no passengers are still present. The time delay between sending the initiate command 108 to verifying the image of the traffic flow light 104 responding to the initiate command 108 will be calculated. Depending on the time delay calculated and whether the time delay calculated is within defined limits, the start and stop buttons 110 may become active. However, if the time delay calculated is out of limits, the buttons remain inactive, and the program jumps back to the initiate step 204 without the need to be pressed again. This leads to a continuous calculated time delay that will be checked again until it is within certain limits, which will be further described herein in reference to FIG. 4. As long as the time delay is within given limits the program progresses to the next step 210 and permits the user to control the passenger conveyor 10 by activating the buttons 110 in step 208.

The camera 102 may also adjust its focal view of the passenger conveyor 10, e.g. by expanding or contrasting, depending on the time delay calculated. For instance, if the time delay calculated is closer to the upper allowable limit, then the camera 102 may expand its focal view in order to get a broader perspective of the passenger conveyor 10 and surrounding platforms 12, 14. The broader perspective may provide extra time to ensure that no passengers are approaching the passenger conveyor 10 since the image may not be refreshed as frequently due to a later real-time response. On the other hand, if the time delay calculated is closer to zero, which may be the lower allowable limit, then the camera 102 may contrast its focal view to concentrate on the passenger conveyor 10 with confidence, knowing the image is refreshed frequently due to a steady real-time response. Once the buttons 110 become active, the remote control center 106 may remotely control the passenger conveyor 10 as long as the buttons 110 in step 210 remain active. At any point during the remote control process, if the remote control center 106 experiences poor communication due to a long time delay being calculated or loses communication with the camera 102 or the traffic flow light 104, for example, if the traffic flow light 104 is not responding to the initiate command, or the image from the camera 102 is not being refreshed, the buttons 110 will become inactive and remote operation of the passenger conveyor 10 may be terminated. While the foregoing process relies on human visual inspection and comparison of images, it should be understood that automated, computer based comparison of the images are also contemplated and would be consistent with, and reasonably within the scope of this disclosure.

Figure 4:
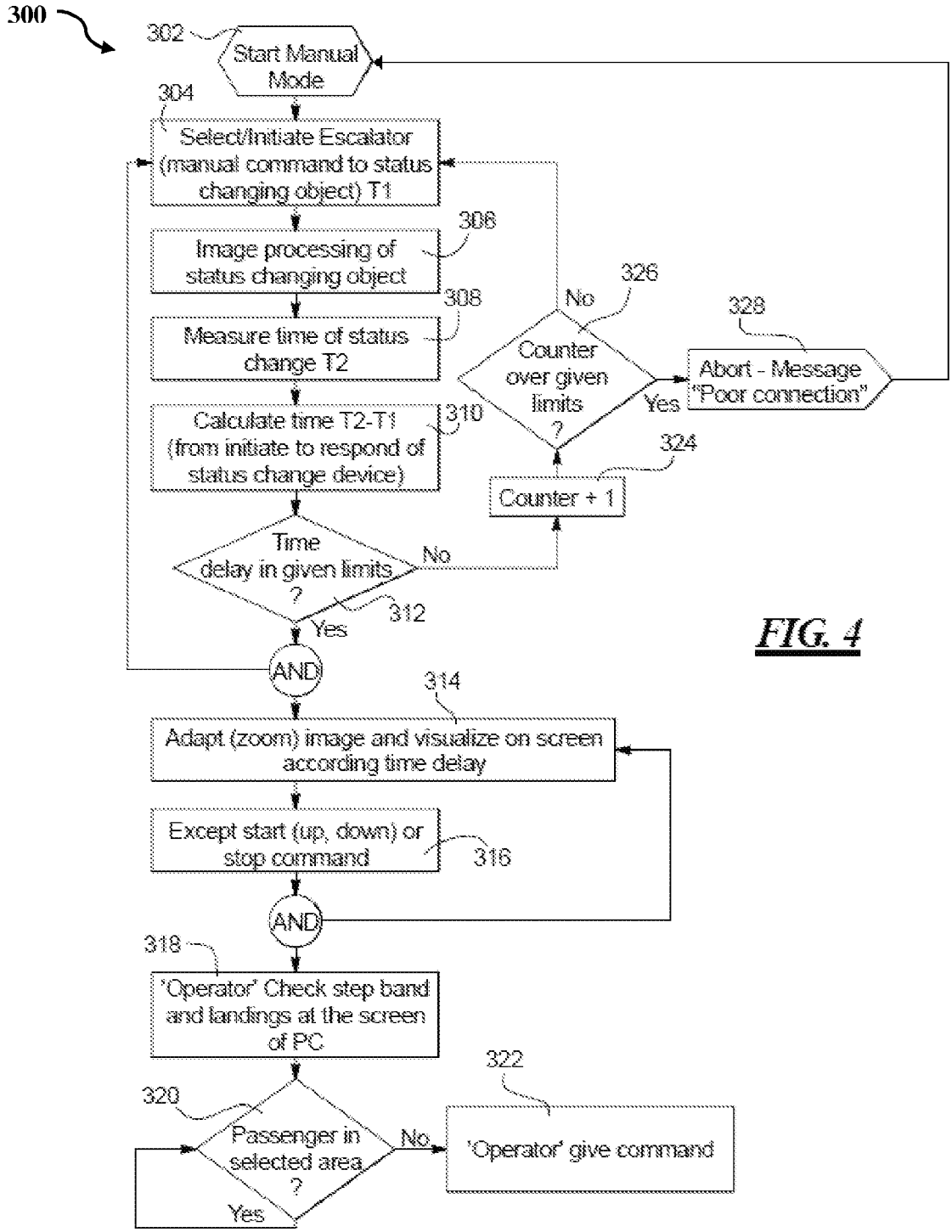
FIG. 4 is a flowchart depicting a sample sequence of steps which may be practiced in accordance with the method of the present disclosure.

While FIG. 3 is a pictorial representation of the escalator remote control process, FIG. 4 shows the process in a flow chart with a sample sequence of steps 300 of manually remotely controlling the escalator 10. Manual mode may be activated in step 302. In step 304, the escalator for remote control may be selected, the initiate command 108 may be sent to the status changing object 104, and a timer may be started, wherein start time $T_1$ may be recorded. In one exemplary embodiment, the initiate command 108 may consist of an instruction for a continuous non-periodic blinking pattern, e.g. 0.5 seconds ON, 0.7 seconds OFF, 1.2 seconds ON, 0.3 seconds OFF, etc., being sent to the status changing object 104, wherein the status changing object 104 may change states based on the pattern received. It should be understood that many other patterns may be feasible in order to change the state of the status changing object 104 and to successfully verify the response of the status changing object to the command, as described below in further detail.

Once the initiate command 108 has been sent, the image of the status changing object 104 is checked to verify that the status changing object 104 is indeed changing states based on the pattern received, in step 306. Once the remote control center 106 has detected an image wherein the status changing object 104 has responded to the initiate command 108, the timer may be stopped, and a verification time $T_2$ may be recorded, in step 308. In step 310, a time delay between the initiate command and verification of the change of the status-changing object 104 (e.g., traffic flow light) in response to the initiate command may be calculated based on recorded times $T_1$ and $T_2$. In step 312, it is determined whether the calculated time delay is within an allowable (or acceptable) range. Meanwhile the program jumps to step 304 and starts the initiate process on its own by sending a non-periodic pattern. Once the time delay calculated is verified, the image of the remote control center 106 may be adjusted. For example, if the acceptable range of time delay values is set between 0 and 1.0 seconds, and the time delay is calculated to be 0.8 seconds, then the focal perspective of the image of the passenger conveyor 10 may be readjusted based on the time delay calculated, in step 314. If the calculated time delay is within the acceptable range of values, the buttons 110 may be activated for a limited time frame in order to remotely control the escalator 10, in step 316. The operator may then check the camera image, in step 318, to ensure that no passengers are present on the passenger conveyor 10 or on the platform areas 12, 14. If it is verified in step 320 that no passengers are present in the selected areas, the operator may initiate the active buttons 110 for remote control of the escalator 10, in step 322.

Referring back to step 312, if the time delay is not within the allowable time limit, then a counter may be incremented, in step 324. The counter is then checked in step 326 to ensure it has not exceeded a predetermined limit. If the counter has exceeded this limit, then the algorithm may be aborted, in step 328, due to poor connection resulting in a repeated time delay that is greater than the acceptable range, or an inability to verify that the status changing object 104 has responded to the initiate command 108, and the process flow may revert back to the start of the algorithm, step 302. Otherwise, if the counter has not exceeded predetermine limits, the algorithm reverts back to step 304, and continues with the remote control process at this point.

Figure 5:
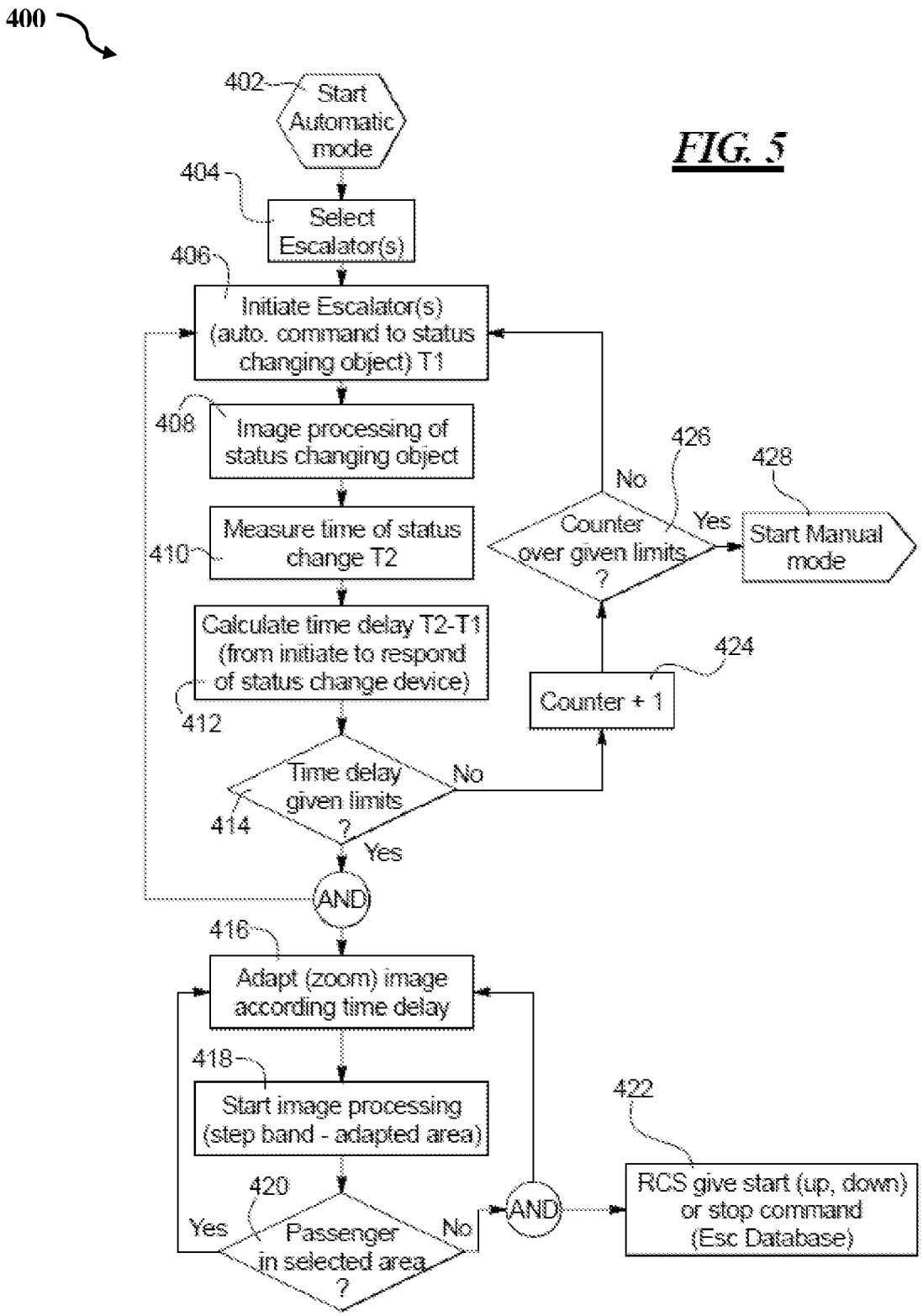
FIG. 5 is a flowchart depicting another sample sequence of steps which may be practiced in accordance with the method of the present disclosure It should be understood that the drawings are not necessarily to scale and that the disclosed embodiments are sometimes illustrated diagrammatically and in partial views. In certain instances, details which are not necessary for an understanding of the disclosed methods and systems, or which render other details difficult to perceive, may have been omitted. It should be understood, of course, that this disclosure is not limited to the particular embodiments illustrated herein.

FIG. 5 shows a flow chart with an example sequence of steps 400 of automatically remotely controlling the escalator 10. Automatic mode may be activated in step 402. In step 404, the escalator to be remotely controlled is selected. In step 406, the initiate command 108 may be sent to the status changing object 104, and a timer may be started, wherein start time $T_1$ is recorded. In one exemplary embodiment, the initiate command 108 may consist of an instruction for a continuous non-periodic blinking pattern, e.g. 0.5 seconds ON, 0.7 seconds OFF, 1.2 seconds ON, 0.3 seconds OFF, etc., being sent to the status changing object 104, wherein the status changing object 104 may change states based on the pattern received. It will be understood that many other patterns may be feasible in order to change the state of the status changing object 104 and to successfully verify the response of the status changing object 104 to the command.

Once the initiate command 108 has been sent, the image of the status changing object 104 is checked in step 408 to verify that the status changing object 104 is indeed changing states based on the pattern received. In one exemplary embodiment, the remote control center 106 may have an image identification system for detecting objects in an image. Once the remote control center 106 has detected an image wherein the status changing object 104 has responded to the initiate command 108, the timer may be stopped, and a verification time $T_2$ may be recorded, in step 410. A time delay between the initiate command 108 and verification of the change of the status changing object 104 (e.g., traffic flow light) in response to the initiate command 108 may be calculated based on recorded times $T_1$ and $T_2$, in step 412. In step 414, it is determined whether the calculated time delay is within an allowable (or acceptable) range. Meanwhile the program jumps to step 406 and starts the initiate process on its own by sending a non-periodic pattern. Once the time delay calculated is verified, the image of the remote control center 106 may be adjusted. For example, if the acceptable range of time delay values is set between 0 seconds and 1.0 seconds, and the time delay is calculated to be 0.8 seconds, then the focal perspective of the image of the passenger conveyor 10 may be readjusted based on the time delay calculated, in step 416. Image processing may then be activated to ensure that no passengers are present on the passenger conveyor 10 or on the platform areas 12, 14, in step 418. Once it is verified, in step 420, that no passengers are present in the selected area, the remote control center 106 may initiate the active buttons 110 for remote control of the escalator 10, in step 422.

Referring back to step 414, if the time delay is not within the allowable time limit, then a counter may be incremented, in step 424. The counter is then checked, in step 426, to ensure it has not exceeded a predetermined limit. If the counter has exceeded such limit then manual mode, as previously described with reference to FIG. 4, may be activated, in step 428. Otherwise, if the counter has not exceeded its given limits, the algorithm reverts back to step 406, and continues with the automatic remote control process.

It should be understood that the allowable time frames may be adjusted based on requirements of system 100. Furthermore, the camera 102 may also be capable of readjusting its focal perspective based on the time delay calculated and requirements of system 100. Moreover, the remote control system 100 may be operated manually by an operator or automatically by the remote control center 106. For example, in manual mode, the operator may inspect the image of the passenger conveyor 10 and the status changing object 104, and control the buttons 110 once they become active. In automatic mode, the remote control center 106 may use an image identification system to detect changes in the image of the passenger conveyor 10 and status changing object 104, and control the buttons 110 once they become active. It should also be understood that although description for the embodiments herein have been provided for a single escalator/passenger conveyor, the remote control system 100 may be capable of monitoring, testing, and controlling multiple passenger conveyors simultaneously, especially in automatic mode.

In light of the foregoing, it can be seen that the present disclosure sets forth a system and method for remotely controlling a passenger conveyor in real time. Such a passenger conveyor can be provided in the form of, but not limited to, an elevator, an escalator, a moving walkway, or the like. While utilizing non-certified equipment, a remote control system for the passenger conveyor may continuously verify that an image of the passenger conveyor and a status changing object is current, and may enable remote control of the passenger conveyor for a limited time frame. The remote control system may include a remote control center, such as a laptop, that may continuously send an initiate command consisting of a pattern to the status changing object, instructing the status changing object to change states based on the pattern. The remote control center then calculates a time delay from the time the initiate command is sent to the time the image of the status changing object verifies that the status changing object is responding to the initiate command. Based on the calculated time delay, the remote control center may establish the limited time frame for remotely controlling the passenger conveyor. The time delay also may provide a feedback for the remote control center to determine the limited time frame to remotely operate the passenger conveyor and for the camera to adjust the focal perspective of the passenger conveyor being captured. Such continuous verification of communication between the remote control center, the status changing object, and camera may ensure that the remote control system is operating in real time. By ensuring real time operation, while utilizing non-certified commercial equipment, the remote control system may provide an upgradable low-cost solution for remotely monitoring, testing, and controlling a passenger conveyor.

While only certain embodiments have been set forth, alternatives and modifications will be apparent from the above description to those skilled in the art. These and other alternatives are considered equivalents and within the spirit and scope of this disclosure and the appended claims.

What is claimed is:

1. A method for remotely controlling a passenger conveyor having a platform at each end, comprising:

providing a status changing object capable of changing visually observable states;

capturing an image of the passenger conveyor and the status changing object using a camera;

sending the image captured by the camera to a remote control center capable of displaying the image of the passenger conveyor with status changing object received from the camera, and capable of controlling the status changing object;

sending an initiate command from the remote control center to the status changing object;

receiving an image of the passenger conveyor with the status changing object responding to the initiate command;

calculating a time delay based on a time the initiate command is sent to a time the image of the status changing object received by the remote control center from camera verifies that the status changing object is responding to the initiate command; and initiating a limited time frame for remote control of the passenger conveyor based on the time delay calculated.

2. The method of claim 1, wherein the step of initiating the limited time frame for remote control of the passenger conveyor is performed by changing the state of at least one button in the remote control center from an inactive state to an active state, to enable remote control of the operation of the passenger conveyor for a limited amount of time based on the calculated time delay.

3. The method of claim 1, wherein the step of calculating the time delay is performed by the remote control center.

4. The method of claim 1, wherein the step of calculating the time delay includes recording a time the remote control center sends the initiate command to the status changing object and recording a time of verification that the status changing object is responding to the initiate command.

5. The method of claim 1, wherein the step of sending the initiate command from the remote control center to the status changing object is performed by sending a pattern to the status changing object, wherein the status changing object changes visually observable states based on the pattern.

6. The method of claim 1, wherein the status changing object is any type of lamp, such as a traffic flow light, and the step of sending an initiate command from the remote control center to the status changing object is performed by sending commands consisting of a pattern of light pulses to a traffic flow light, wherein the traffic flow light displays the light pulses according to the pattern received.

7. The method of claim 1, wherein the steps of capturing the image of the passenger conveyor and initiating the limited time frame to control the passenger conveyor are dependent on the time delay calculated.

8. The method of claim 1, further including the step of confirming by visual inspection of the image of the passenger conveyor displayed on the remote control center that no passengers are present on the passenger conveyor.

9. The method of claim 1, wherein the camera is a commercially available camera.

10. The method of claim 1, further comprising the step of remotely controlling the passenger conveyor by one of manual operation and automatic operation, wherein manual operation is performed by an operator and automatic operation is performed by the remote control center.

11. A method for remotely controlling a passenger conveyor, comprising:

providing a status changing object capable of changing visually observable states;

continuously capturing an image of the passenger conveyor and the status changing object using a camera;

sending the captured image to a remote control center capable of displaying the image of the status changing object and the passenger conveyor received from the camera;

sending continuously an initiate command consisting of a pattern to the status changing object, wherein the status changing object changes its visually observable state according to the pattern;

receiving continuously an image of the status changing object responding to the initiate command;

calculating continuously a time delay between a time the initiate command is sent to the status changing object to a time the image of the status changing object received by the remote control center from camera verifies that the status changing object is responding to the initiate command;

initiating a limited time frame for remote control of the passenger conveyor based on the time delay calculated; and adjusting the image captured of the passenger conveyor based on the time delay calculated.

12. The method of claim 11, wherein the step of initiating the limited time frame for remote control of the passenger conveyor is performed by changing the state of at least one button in the remote control center, from an inactive state to an active state, to enable remote control of the operation of the passenger conveyor for a limited amount of time based on the time delay calculated.

13. The method of claim 11, wherein the steps of capturing, sending, and calculating continuously ensures real time communication between the remote control center, the status changing object, and the camera such that when one of the camera, status changing object, and remote control center fails to communicate continuously, the limited time frame for remote control of the passenger conveyor is discontinued.

14. The method of claim 11, wherein the status changing object is a traffic flow light and the step of sending continuously the initiate command consisting of the pattern to the status changing object performed by sending commands consisting of a pattern of light pulses to a traffic flow light, wherein the traffic flow light displays the light pulses according to the pattern.

15. The method of claim 11, further comprising the step of remotely controlling the passenger conveyor by one of manual operation and automatic operation, wherein manual operation is performed by an operator and automatic operation is performed by the remote control center.

16. A passenger conveyor having a remote control system comprising:

a status changing object associated with the passenger conveyor and capable of changing states;

a camera associated with the passenger conveyor to capture an image of the entire passenger conveyor and the status changing object; and a remote control center remotely located from the passenger conveyor that is capable of receiving the image from the camera and controlling the status changing object and the passenger conveyor within a limited time frame.

17. The passenger conveyor of claim 16, wherein the limited time frame is dependent upon a time delay calculated by the remote control center, said time delay being measured from a time the remote control center sends an initiate command to the status changing object to the time the status changing object responds to the initiate command.

18. The passenger conveyor of claim 17, wherein a focal perspective of the image captured by the camera is dependent on the time delay calculated.

19. The passenger conveyor of claim 16, wherein the camera is a commercially available camera.

20. The passenger conveyor of claim 16, wherein the status changing object is selected from a group consisting of a traffic flow light, flashing light, and a digital clock.

* * * * *